US005829915A

United States Patent [19]

Andreassen

[11] Patent Number: 5,829,915

[45] Date of Patent: Nov. 3, 1998

[54] FLEXIBLE FORMWORK

[76] Inventor: Henry Andreassen, Frekadalsveien 1, N-5305 Erdal, Norway

[21] Appl. No.: 704,779

[22] PCT Filed: Mar. 3, 1995

[86] PCT No.: PCT/NO95/00047

§ 371 Date: Sep. 9, 1996

§ 102(e) Date: Sep. 9, 1996

[87] PCT Pub. No.: WO95/24531

PCT Pub. Date: Sep. 14, 1995

[30] Foreign Application Priority Data

Mar. 8, 1994 [NO] Norway ..... 940801

[51] Int. Cl.[6] ..... E02B 3/12

[52] U.S. Cl. ..... 405/18

[58] Field of Search ..... 405/18, 19, 17, 405/16, 15, 20, 222, 91

[56] References Cited

U.S. PATENT DOCUMENTS

| | | | |
|---|---|---|---|
| 3,486,341 | 10/1969 | Heuskerstiewe et al. . | |
| 3,520,142 | 7/1970 | Turzillo . | |
| 3,524,320 | 8/1970 | Turzillo | 405/18 |
| 3,745,775 | 7/1973 | Kahn | 405/222 |
| 3,837,169 | 9/1974 | Lamberton | 405/18 |
| 3,922,832 | 12/1975 | Dicker | 405/18 X |
| 4,154,061 | 5/1979 | Umemoto et al. | 405/19 |
| 4,184,788 | 1/1980 | Colle . | |
| 4,362,433 | 12/1982 | Wagner et al. | 405/18 X |
| 4,449,847 | 5/1984 | Scales et al. . | |
| 4,690,585 | 9/1987 | Holmberg . | |
| 4,889,446 | 12/1989 | Holmberg . | |
| 4,921,373 | 5/1990 | Coffey | 405/91 X |

FOREIGN PATENT DOCUMENTS

| | | |
|---|---|---|
| 8909864 | 10/1989 | European Pat. Off. . |
| 0429752 | 6/1991 | European Pat. Off. . |
| 1684357 | 4/1976 | Germany . |
| 2458289 | 6/1976 | Germany . |
| 141346 | 11/1979 | Norway . |
| 421543 | 6/1981 | Sweden . |
| 1475682 | 6/1977 | United Kingdom . |

OTHER PUBLICATIONS

"Fabriform Metoden"—Entreprenorservice AS, Oslo, Norway 1.

"Porous Lost Shutters",CN Magazine, Editor Mike Phillips.

*Primary Examiner*—Tamara L. Graysay
*Assistant Examiner*—Frederick L. Lagman
*Attorney, Agent, or Firm*—Stevens, Davis, Miller & Mosher, L.L.P.

[57] ABSTRACT

A formwork (1), particularly for use when casting horizontally and slopingly lying areas. The formwork (1) is substantially formed as a flat bag of PVC or another suitable cloth material consisting of a top cloth (1) and a bottom cloth attached to each other along the edges through welding or by means of zip fasteners. Between top cloth (1) and bottom cloth, a number of spacers (4) are disposed.

4 Claims, 4 Drawing Sheets

FLEXIBLE FORMWORK

BACKGROUND OF THE INVENTION

Field of the Invention

This invention relates to a flexible and collapsible formwork, particularly for use when casting submarine areas as well areas above water level, e.g. the bottom of ferry landings, the external side of moles, rock fills, fill dams for power plants, encapsulating wrecked ships and other objects desirable to shield due to environmental purposes, and with a number of other casting works.

Objects of the Invention

The object of the invention is to provide a simple and handy formwork for the above-mentioned purposes and which may be produced on a manufacturing scale.

The object is achieved through the features as defined in claim 1 below.

BRIEF DESCRIPTION OF THE DRAWINGS

An embodiment of the invention is diagrammatically shown in the attached drawings, in which.

DESCRIPTION OF THE PREFERRED EMBODIMENTS

Figure 3:
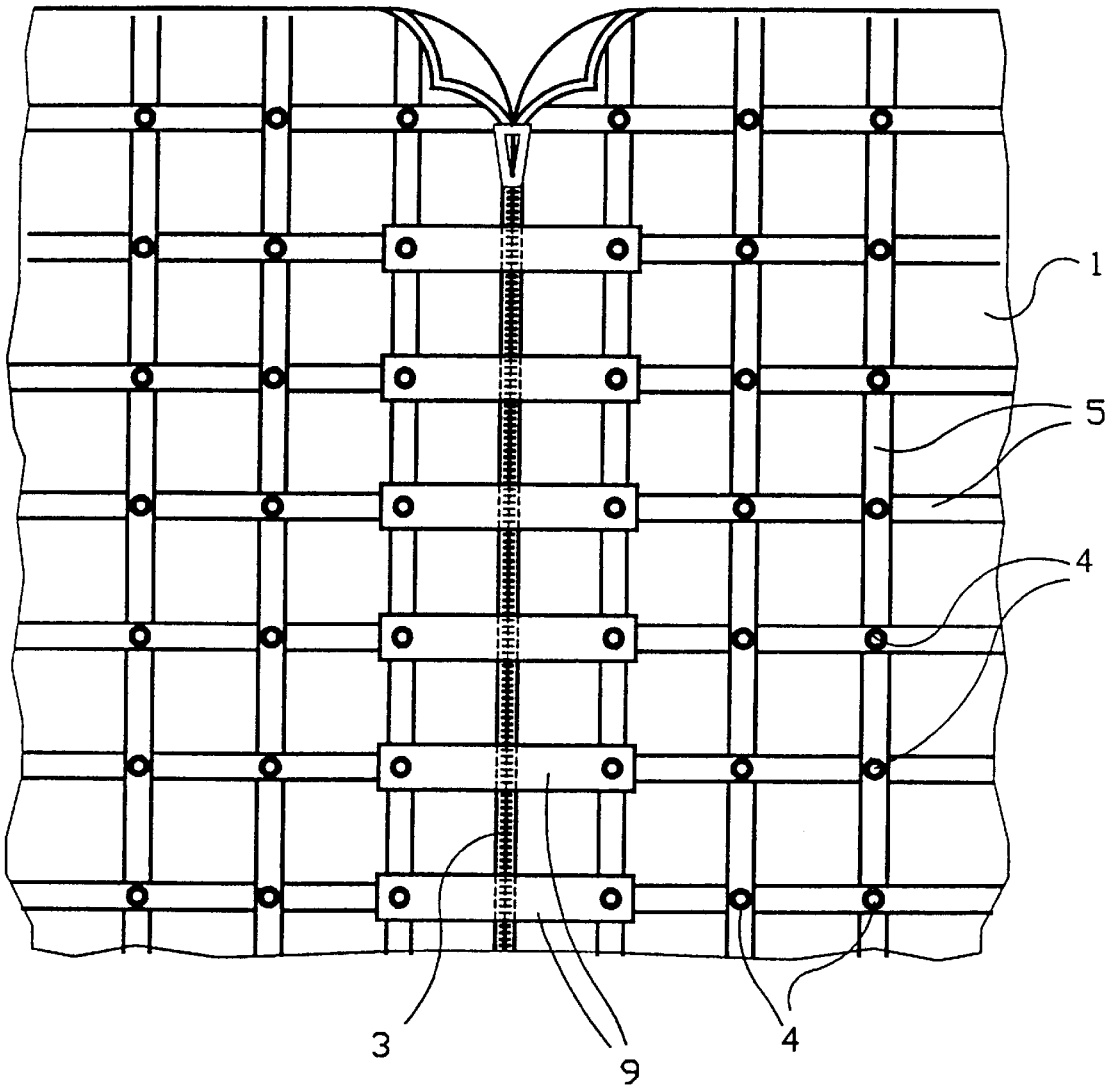
FIG. 3 shows a formwork joint.

In the drawings, reference numerals 1 and 2 respectively denote a top cloth and a bottom cloth of PVC or another suitable cloth material having a sufficient flexibility and strength to take up the loads to which the formwork is subjected. The top cloth 1 and the bottom cloth 2 form respectively an external and an internal formwork. Top cloth 1 and bottom cloth 2 are welded together along the edges. They may also be joined by means of zip fasteners 3, as shown in FIG. 3. Intermediate the two cloths 1 and 2, a number of spacers 4 are placed, so that the formwork forms a substantially flat bag, a formwork bag 1,2. On the outside thereof, this bag is provided with a number of mutually crossing reinforcing straps 5, and a spacer 4 is disposed through each of the crosses formed by the reinforcing straps 5. The spacers 4 may be rigid or flexible.

Figure 1:
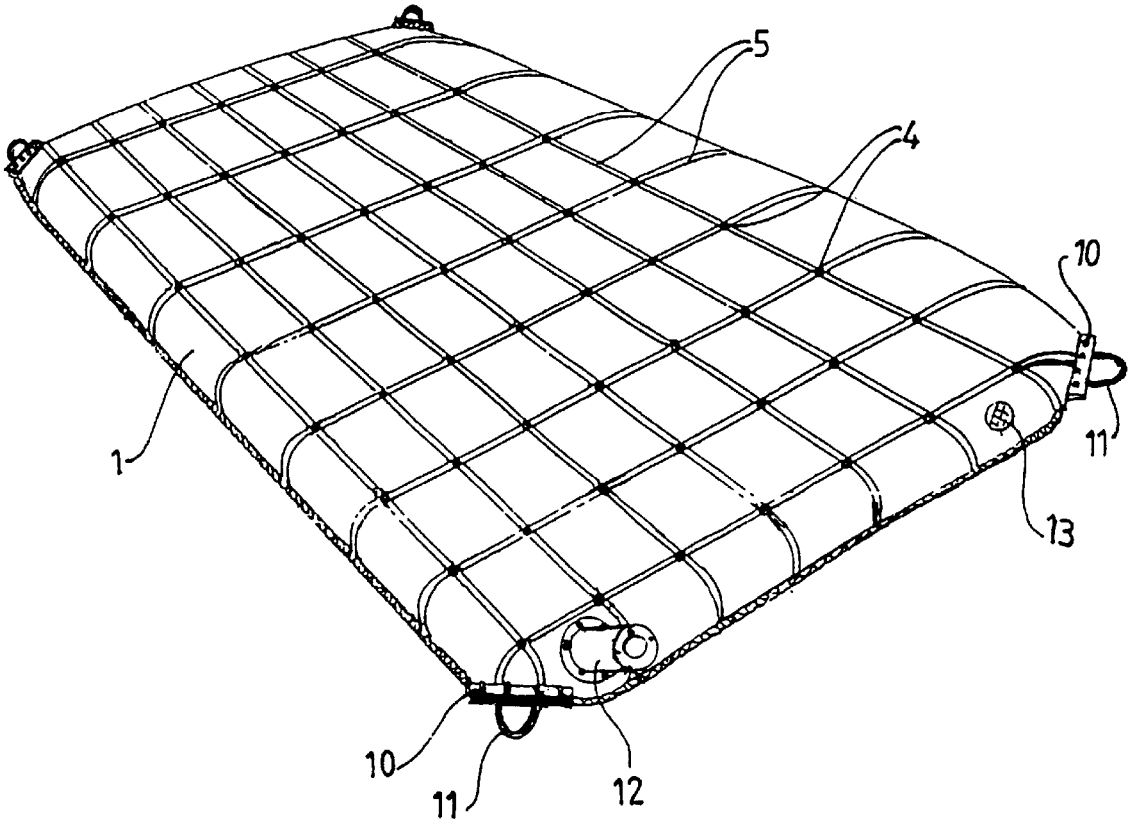
FIG. 1 shows a perspective view as seen obliquely from above of a pre-fabricated formwork.
Figure 2:
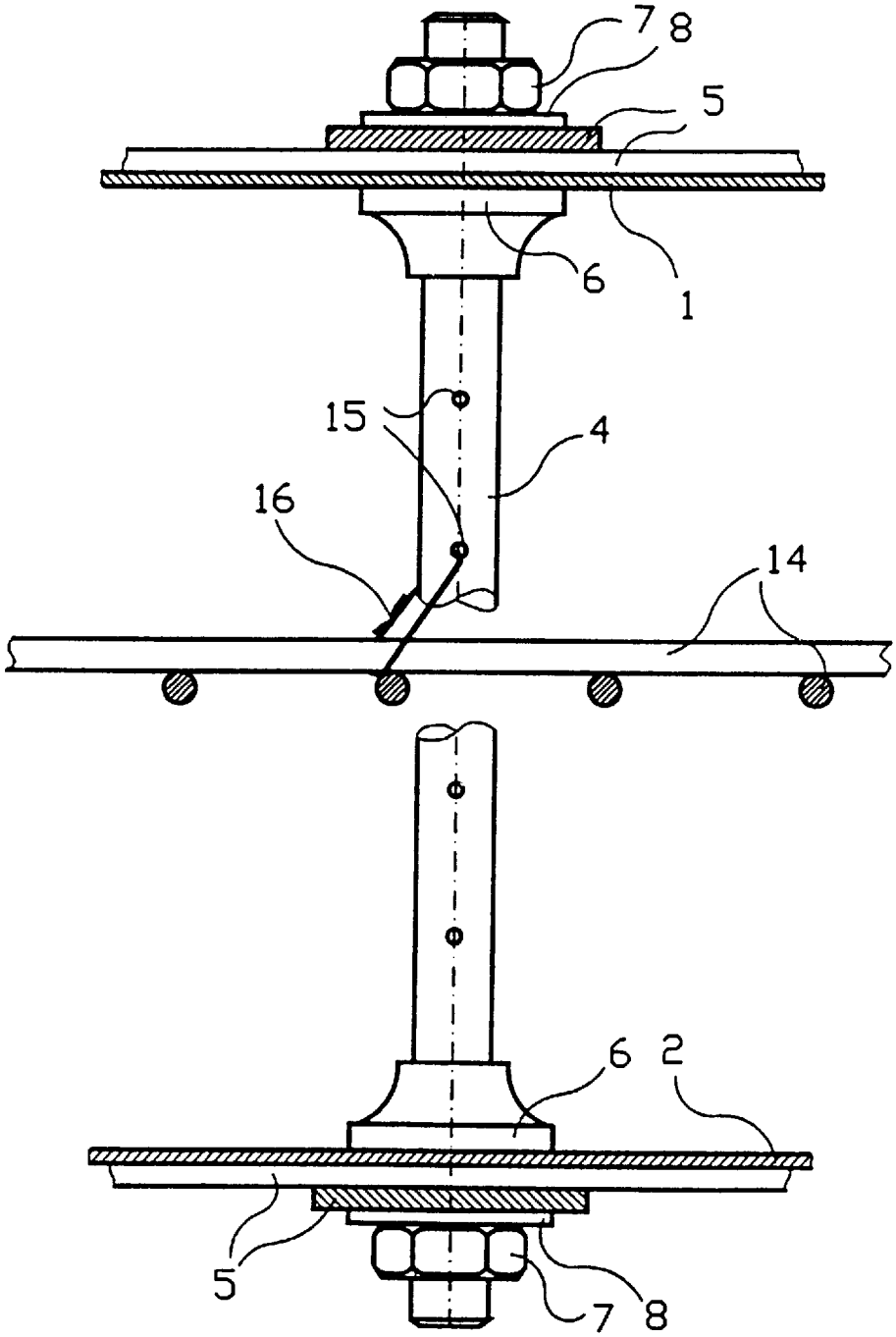
FIG. 2 shows on a larger scale a section through the formwork.

In the embodiment, the spacers 4 consist of synthetic fibre bars each having two fixed bracket projections 6, securing a correct distance between the cloths 1 and 2, the inner side of the cloth 1 respectively 2 resting against the outside of the bracket projection 6 of the spacers 4, while a nut 7 with a washer 8, at each end of the spacer 4, clamps the reinforcing straps 5 firmly against the cloth 1 respectively 2 as shown in FIG. 2.

Where edges of the cloths 1, 2 are joined by means of zip fasteners 3, a number of extra reinforcing straps 9, anchored in at least one row of spacers 4 at each side of the zip fastener, has been placed.

At exposed positions, each single formwork bag 1,2 is suitably equipped with reinforcements 10 and, moreover, with loops 11 for towage. Moreover, each single formwork bag is equipped with at least one coupling stub 12 for the filling of concrete into the bag, and a number of venting valves 13 in order to allow air to escape as concrete is being filled into the formwork bag 1,2.

Prior to the top cloth's 1 attachment to the bottom cloth 2, the formwork bag 1,2 may be provided with a reinforcement 14 consisting of e.g. wire mats and/or usual steel reinforcement. To this end, the spacers 4 are provided with a number of holes 15 for the attachment of binding cords 16 in order to keep the reinforcement in position.

The formwork bag 1,2 may be produced in different sizes and with different shapes and profiles, dependent on the field of application and, by means of zip fasteners, any number of formwork bags 1,2 may easily be built together to form a formwork of any size.

Figure 4:
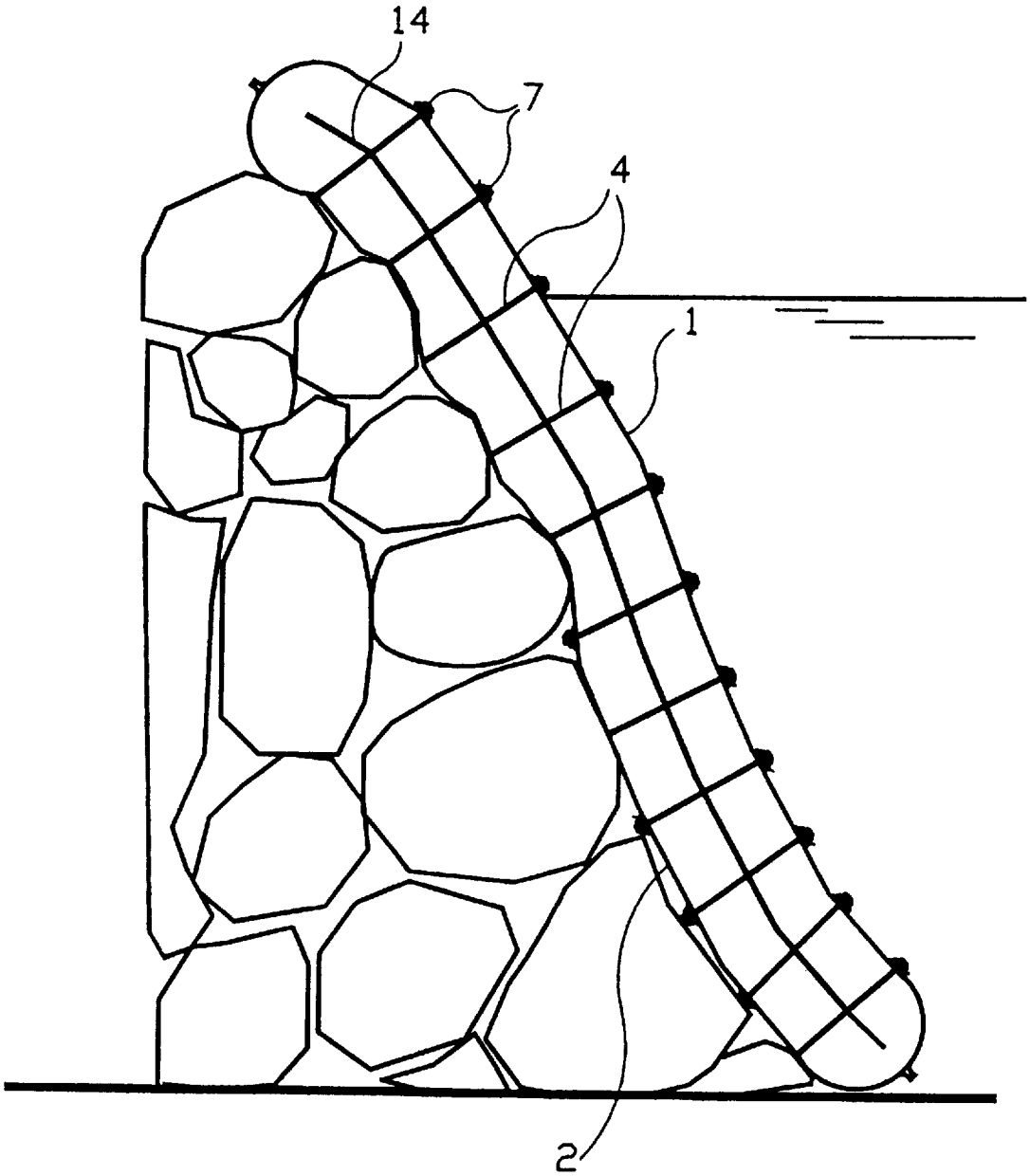
FIG. 4 is an end view of a formwork placed on a rock fill, partly above and partly beneath water, and where the formwork is filled with concrete.

As it appears from FIG. 4, the formwork will, due to its flexibility, adapt itself to the substrate such that the latter becomes well bonded, and such that the whole forms a good total structure.

It is appreciated without saying that the top cloth 1, possibly also the bottom cloth 2, at appropriate places might be formed with one or more bracket projections which, subsequent to casting, will form a suitable base for e.g. quai works or other structures.

The formwork according to the invention has generally a very good ability to adapt itself; it may be used for many different purposes; it may substantially be pre-fabricated; it may be rolled together and, thereby, easy to transport; it is easy to position, and specially trained workers are not required in order to operate the formwork.

Subsequent to the casted concrete's, the upper parts of the formwork bag may, of course, be removed if so desired.

I claim:

1. A formwork intended to be used when casting a concrete body on horizontally and slopingly lying areas, comprising a bag of small thickness consisting of a formwork bag made from a suitable cloth material exhibiting sufficient flexibility and strength in order to take up loads to which the formwork bag is expected to be subjected, said formwork bag consisting of a top cloth and a bottom cloth, forming respectively an external and an internal formwork wall, said top and bottom cloths being connected to each other along adjacent edge portions, a plurality of spacers being disposed intermediate top and bottom cloths and distributed across the area thereof, said formwork bag being provided with an internal main reinforcement, said spacers being provided with means for the attachment of binding cords to be attached to the main reinforcement, thus interconnecting the internal main reinforcement with said spacers, keeping the main reinforcement in place, said top cloth and said bottom cloth of the formwork bag being provided with additional reinforcement consisting of externally positioned, mutually crossing first reinforcing straps.

2. A formwork as set forth in claim 1, wherein said connected edges of top and bottom cloths are joined by means of zip fasteners, a plurality of second reinforcing straps, said second reinforcing straps being anchored to a row of spacers at either side of said zip fasteners, strengthening those straps of said first reinforcing straps extending parallel to each other and to said second reinforcing straps, the remaining first straps extending perpendicular thereto.

3. A formwork as set forth in claim 2, wherein each spacer consists of an artificial fiber bar having two bracket projections which come to rest against the internal side of top and bottom cloths, respectively, said spacer at both ends thereof having clamp means in the form of a nut and a washer, adapted to clamp said first reinforcing straps firmly against the formwork bag.

4. A formwork as set forth in claim 3, wherein crossing points in the form of nodes formed by said first reinforcing straps on the top cloth of the formwork bag, through said spacers, are connected to similar crossing points in the form of nodes formed by said first reinforcing straps on the bottom cloth.

* * * * *